US007407041B2

(12) United States Patent
Jungbauer et al.

(10) Patent No.: US 7,407,041 B2
(45) Date of Patent: Aug. 5, 2008

(54) METHOD OF CONSTRUCTING AN ELEVATOR INSTALLATION, AND ELEVATOR INSTALLATION FOR THAT PURPOSE

(75) Inventors: Manfred Jungbauer, Schlüchtern (DE); Claus Luther, Frankfurt/a.Main (DE); Beate Sbielut, Nidderau (DE); Peter Kron, Hahnheim (DE)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/558,097

(22) Filed: Nov. 9, 2006

(65) Prior Publication Data

US 2007/0181381 A1 Aug. 9, 2007

(30) Foreign Application Priority Data

Nov. 9, 2005 (EP) ..... 05110560

(51) Int. Cl.
*B66B 11/02* (2006.01)
*B66B 7/02* (2006.01)

(52) U.S. Cl. ..... 187/900; 187/401; 187/408

(58) Field of Classification Search ..... 187/266, 187/408, 414, 256, 401, 900; 166/77.52
See application file for complete search history.

(56) References Cited

U.S. PATENT DOCUMENTS 3,124,223 A * 3/1964 Kisovec ..... 52/632
3,196,996 A * 7/1965 De La Rambelje ..... 52/127.5
3,298,462 A * 1/1967 Morris ..... 187/262
3,519,101 A * 7/1970 Sieffert ..... 187/256
3,680,711 A * 8/1972 Brucker ..... 211/105.3
5,033,586 A * 7/1991 Richards et al. ..... 187/259
5,035,300 A * 7/1991 Chapelain et al. ..... 187/266
2005/0150728 A1 * 7/2005 Van Der Meijden et al. 187/411

FOREIGN PATENT DOCUMENTS

DE 1 900 971 A1 9/1969
FR 2 694 279 A 2/1994
WO WO 01/64572 A 9/2001
WO WO 0164572 A1 * 9/2001
WO WO 2004/050526 A 6/2004

* cited by examiner

*Primary Examiner*—Peter M. Cuomo
*Assistant Examiner*—Eric Pico
(74) *Attorney, Agent, or Firm*—Fraser Clemens Martin & Miller LLC; William J. Clemens

(57) ABSTRACT

A method of constructing an elevator installation having a support plate with a drive unit in a first installation position, an elevator car and a counterweight and in which the drive unit is connected by a support cable with the elevator car and the counterweight. A cross member has a chain hoist and is mounted above a second installation position, the chain hoist being connected with the support plate by a chain, the support plate being released from the first installation position, raised by the chain hoist from the first installation position to the second installation position and finally is mounted in the second installation. An elevator installation has at least one recess, which serves for mounting the support plate, formed in a shaft wall.

11 Claims, 2 Drawing Sheets

METHOD OF CONSTRUCTING AN ELEVATOR INSTALLATION, AND ELEVATOR INSTALLATION FOR THAT PURPOSE

BACKGROUND OF THE INVENTION

The present invention relates to a method of constructing an elevator installation and to an elevator installation for that purpose.

In the erection of multi-floor buildings the number of floors to be served in the course of the basic building work, and the travel height of the elevator installation, increase. For each increase in the travel height the engine room of the elevator installation together with the drive unit and cable rollers has to be correspondingly raised.

A method of increasing the travel height of an elevator installation is described in German patent specification DE 1 900 971, in which the engine room is raised by the elevatoring mechanism of a scaffolding company. For that purpose a hook of the elevatoring mechanism is hooked into a wire cable loop provided at the engine room. The entire engine room with elevator car mounted thereon is raised to such an extent that the engine bearers, by which the engine room was fastened in the previous installation position, can be removed. After removal of the engine bearers, the engine room and elevator car are raised somewhat above the new installation position. The engine room is fastened in the new installation position by a new set of engine bearers.

An elevatoring mechanism, for example a building crane, is additionally needed for use of the known method. This elevatoring mechanism is usually provided by the construction company responsible for erection of the building. Provision of the elevatoring mechanism is connected with additional costs not only for the manufacturer of the elevator installation, but also for the party ordering the elevator installation. Moreover, the elevator installation manufacturer is made dependent on the construction company.

SUMMARY OF THE INVENTION

An object of the present invention is to provide a method for construction of an elevator installation in which an additional elevatoring mechanism is not needed. Moreover, it an object of the present invention to provide an elevator installation which is particularly suitable for use of the method according to the present invention.

In the method according to the present invention initially a cross member, which has an appropriate chain hoist, is arranged above a second installation position. The chain hoist is connected by way of chains with the support plate and the support plate is released from a first installation. The support plate is then raised by the chain hoist from a first installation position to the second installation position. The support plate is mounted in the second installation position.

The method according to the present invention for construction of an elevator installation does not require an additional elevatoring mechanism, i.e. an additional crane, in order to increase the travel height of the elevator. Costs can thereby be saved. Thus, the elevator installation can, with respect to the elevatoring mechanism no longer needed, be constructed independently of a construction company.

In a first embodiment of the present invention the elevator car and the counterweight are secured prior to release of the support plate from the first installation position and the securing is removed again after mounting of the support plate in the second installation position. In that case the cable connection for the drive is detached. In this manner the elevator car and the counterweight are separated from the drive. Correspondingly, a power supply cable is preferably separated from the drive unit prior to release of the support plate from the first installation position and is reconnected with the drive unit after mounting of the support plate in the second installation position.

In a further embodiment of the present invention the support cable connection between the drive unit, the elevator car and the counterweight is released after the securing of the elevator car and the counterweight and is connected again after mounting of the support plate in the second installation position.

In a further embodiment of the present invention the support plate is released from the first installation position in that the support plate is moved vertically by the traction motor and locking devices, which are provided at the ends of the support plate and which in the mounted state protrude laterally beyond the support plate and are folded against the direction of movement of the support plate. Preferably, for the mounting in the second installation position the locking devices are moved in such a manner that they protrude laterally beyond the support plate, wherein cables and/or chains can be used for the movement of the locking devices. This has the advantage that for change of the installation position from the support plate no support components, such as, for example, mounting bearers, have to be removed and remounted in the second, higher installation position. The installation position is not changed, the support plate being drawn through the elevator shaft.

In a further embodiment of the present invention the support plate is released from the first installation position in that the support plate is raised from a rest protruding from a shaft wall into the shaft. In a preferred manner the support plate is, for raising to the second installation position, turned through an acute angle to such an extent that it can move through an elevator shaft without contacting the shaft walls. In this embodiment of the present invention as well the advantage is offered that no bearer components have to be removed from the support plate for the raising.

The elevator installation according to the present invention is distinguished by the fact that at least one recess, which serves for mounting the support plate, in a shaft wall is associated with an installation position of a support plate. The support plate can be securely mounted—directly or indirectly—by way of the recess. Moreover, the support plate can be easily released.

In an embodiment of the elevator installation a rest protruding into the shaft is associated with the recess at an opposite shaft wall. This measure makes possible simple mounting of the support plate in an installation position and simple release of the support plate from an installation position.

In an alternative embodiment of the elevator installation a further recess is associated with the recess at an opposite shaft wall. The support plate is provided at opposite ends with locking devices, wherein the locking devices can be mounted in the recesses. This measure also serves for simple mounting and release of the support plate.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
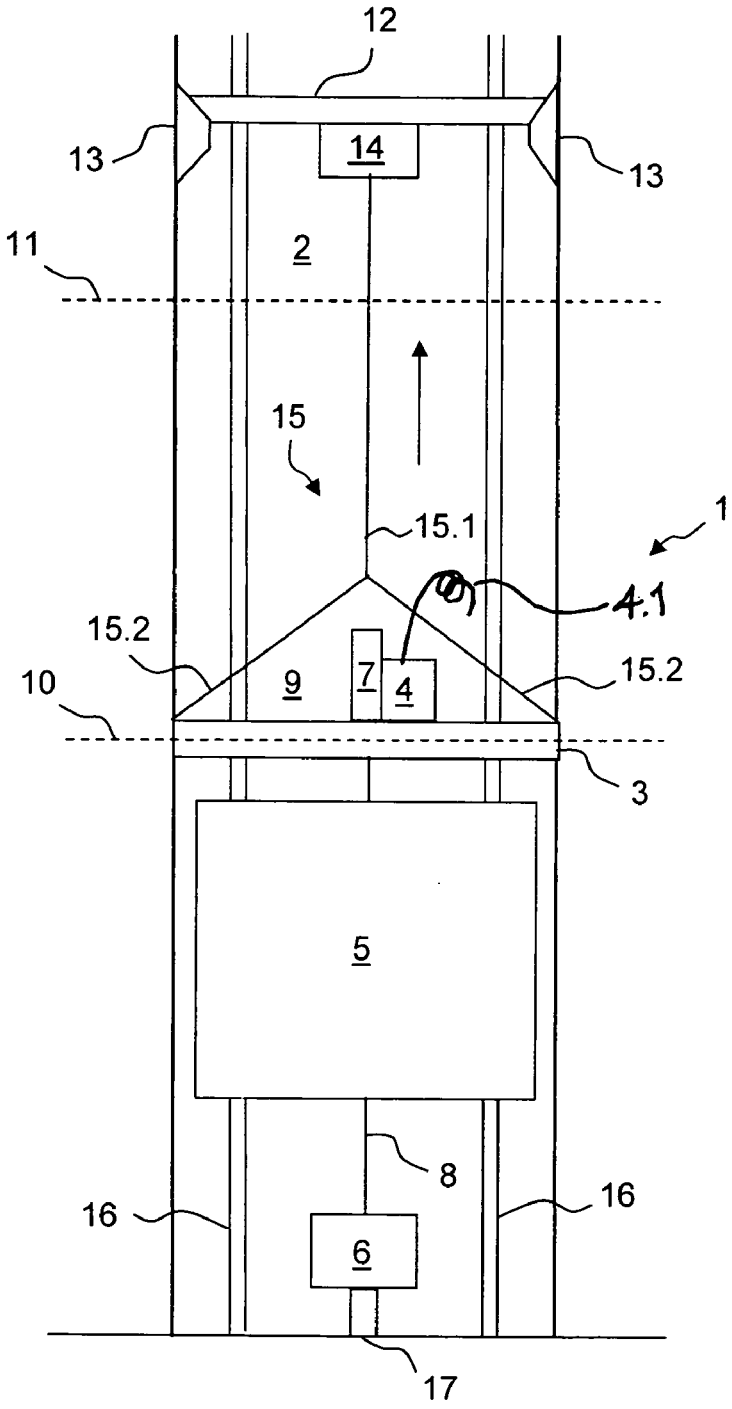
FIG. 1 is a schematic illustration of an elevator installation and a cross member, which has a chain hoist, according to the present invention.

In the figures the same reference numerals denote functionally equivalent components.

An elevator installation 1, which comprises an elevator shaft 2, a support plate 3 with a drive unit 4 arranged thereon, an elevator car 5 and a counterweight 6, is schematically illustrated in FIG. 1. The support plate 3 with the drive unit 4, the elevator car 5 and the counterweight 6 are provided in the elevator shaft 2, wherein the elevator car 5 and the counterweight 6 are arranged below the support plate 3. The drive unit 4, which typically comprises an electric motor, drives a drive pulley 7 around which run one or more support cables 8 connected with the elevator car 5 and the counterweight 6. The constructional space, which is provided for reception of the drive unit 4 and further components required for operation of the elevator installation, such as for example a control apparatus (not illustrated), present above the support plate 3 is termed engine room 9 in the following.

The support plate 3 is mounted in a first installation position 10. The mounting of the support plate 3 is illustrated in FIG. 1 in simplified form. A detailed illustration is provided with respect to FIGS. 2 and 3. For an increase in the travel height of the elevator installation 1 up to a second installation position 11 the support plate 3 is essentially to be raised to the height of the second installation position 11 and mounted there. This is signified in FIG. 1 by an arrow. The distance between the first and second installation positions 10 and 11 can be, for example, twenty-one meters.

For this purpose a cross member 12 is mounted above the second installation position 11. Mounting of the cross member 12 can be carried out from pre-erected mounting platforms (not illustrated) which can be made of wood and mounted in the elevator shaft 2. The cross member 12 is preferably placed on two brackets 13 which are mounted at the walls (not illustrated in more detail) of the elevator shaft 2. The brackets 13 can be anchored in the shaft walls by means of, for example, six fastening elements, for example screws and dowels.

The cross member 12 has a chain hoist 14 which is preferably provided below the cross member 12. The cross member 12 is mounted above the second installation position 11 in such a manner that sufficient free space for reception of the engine room 9 is present between the cross member 12 or—if the chain hoist 14 is arranged below the cross member—between the chain hoist 14 and the second installation position 11. The cross member 12 is mounted, for example, three and one half meters above the second installation position 11. The chain hoist 14 is fastened to corner and/or edge points of the support plate 3 by way of an appropriately dimensioned support chain 15 including a main chain 15.1 and individual secondary chains 15.2. The chain hoist can be a commercially available chain hoist, such as is known to the expert as, for example, a TIRAC hoist. Instead of a chain hoist use can also be made of equivalent traction means such as, for example, a traction hoist co-operating with a belt, etc.

Prior to raising the support plate 3 the elevator car 5 and the counterweight 6 are preferably secured. For securing the elevator car this is set in the safety retainer and connected with guide rails 16 by way of additional safety straps (not illustrated). The counterweight 6 is moved down to the floor of the elevator installation and comes to rest there on a buffer 17. Through securing of the elevator car 5 and the counterweight 6 a corresponding release of the support cables 8 is possible.

The cable connection formed between the drive pulley 7, the elevator car 5 and the counterweight 6 by the support cable 8 is preferably detached prior to raising the support plate 3 to the second installation position 11. In that case the support cable 8 is removed completely from the drive region. After mounting the support plate 3 in the second installation position 11 it is then drawn in again. The support cable 8 preferably has a length enabling operation to a maximum height of the elevator installation 1.

A current supply cable (FIG. 1) 4.1 provided for current supply of the drive unit 4 is separated from the drive unit 4 prior to raising the support plate 3 and secured or demounted in order to prevent fouling of the current supply cable and a risk to persons.

In a given case, scaffolding, mounting platforms or bridge connections to floor roofs, which are installed in the elevator shaft between the first installation position 10 and the second installation position 11 and which are not illustrated, have to be removed for the elevatoring process. Safety rails (not illustrated) provided on the support plate 3 are preferably demounted prior to raising the support platform 3 so as to not obstruct the elevatoring process. The drive unit 4, there against, can advantageously remain on the support platform 3 during the elevatoring process.

The support plate 3 is raised by the chain hoist 14 from the first installation position 10 to the second installation position 11. The support plate 3 is then mounted in the second installation position 11, wherein preferably checking for secure mounting is carried out. After mounting of the support platform 3 the support chain 15 can be detached from the support plate 3. Moreover, after mounting of the support plate 3 safety rails (not illustrated), which may have been removed, are remounted on the support plate 3. Bridge connections to the floor associated with the second installation position 11 can be mounted. The current supply cable can be reconnected with the drive unit 4. The cable connection between the drive pulley 7, the elevator car 5 and the counterweight 6 can be produced again by means of the support cable 8. If the support cable 8 was completely removed for the elevatoring process then the support cable 8 can now be drawn up again. The securing of the elevator car 5 and the counterweight 6 can be removed. Subsequently, the elevator installation 1 is preferably readjusted and can be placed back in operation. The increase in the travel height of the elevator installation 1 can advantageously take place within one working day.

Figure 2:
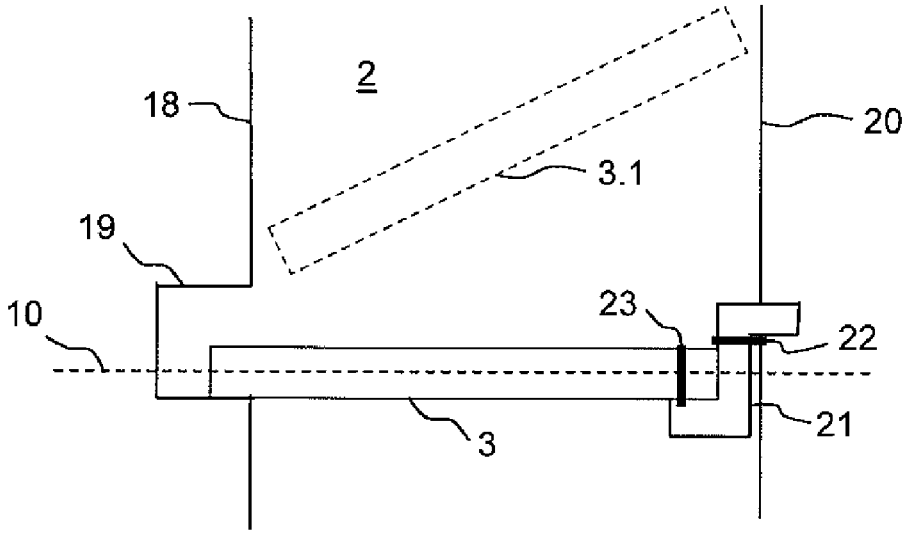
FIG. 2 is a schematic illustration of a part of the elevator installation of FIG. 1 with a support plate in a first embodiment.

FIG. 2 schematically shows a part of the elevator installation in which the support plate 3 is mounted in the first installation position 10. For the mounting of the support plate 3 the elevator shaft 2 has, in a shaft wall 18, at least two recesses 19 formed in such a manner that they can receive an end of the support plate 3.

At an opposite shaft wall 20 there is preferably provided a rest 21 which protrudes into the elevator shaft 2 and which is arranged in such a manner that it can receive an end of the support of the plate 3 so that the support plate 3 comes to lie substantially horizontally in the recess 19 and on the rest 21. Several rests can also be provided instead of the one rest 21. The rest 21 is preferably mounted at that shaft wall 20 in which the access to the floor is provided and, in particular, preferably at the floor roof. The rest 21 can be fastened to the shaft wall 20 by means of screws and dowels 22. In addition, the support plate 3 can be fastened to the rest 21 by means of, for example, screws and dowels 23.

For raising the support plate 3 from the first installation position 10 to the second installation position 11 the support plate 3 is initially raised from the rest 21 by the chain hoist 14, which is illustrated in FIG. 1, by means of the support chain 15 and thereby released from the first installation position 10. The support plate 3 is then turned through an acute angle to such an extent that it can move through the elevator shaft 2 without contacting the shaft walls 18, 20. The support plate 3 is thus raised obliquely or diagonally. This is clarified in FIG. 2 by a support plate 3.1 shown in dashed lines.

A rest 21 is similarly mounted in the second installation position 11, wherein the mounting is carried out as in the first installation position. For mounting of the rest 21 in the second installation position 11 the end of the support plate 3, which is to lie on the rest 21, is preferably raised to such an extent that the rest 21 can be mounted in the shaft wall 20.

The support plate 3 is mounted in the second installation position 11 in that one end of the support plate 3 comes to rest in the recess 19 and the opposite end comes to rest on the rest 21. The support plate 3 can be fastened to the rest 21 by means of, for example, the screws and the dowels 23.

Figure 3:
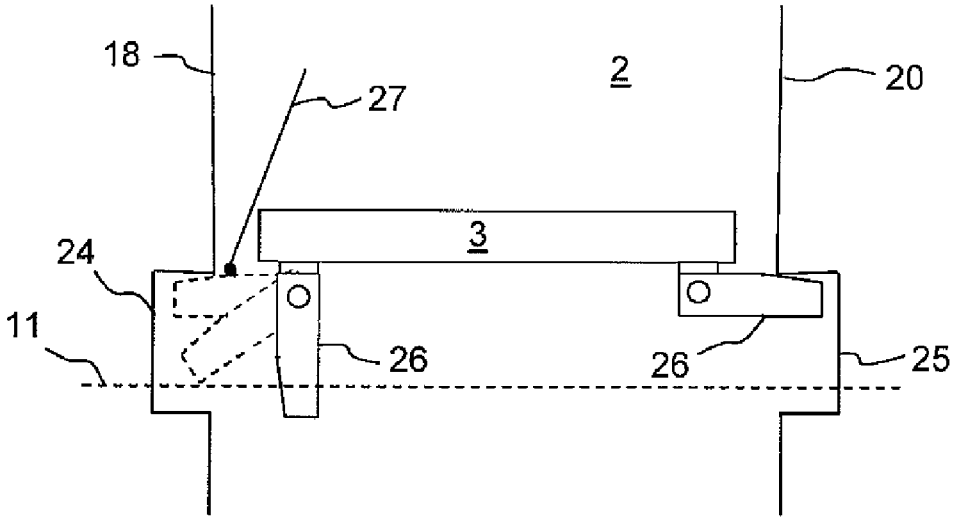
FIG. 3 is a schematic illustration of a part of an elevator installation with a support plate in a second embodiment according to the present invention.

FIG. 3 schematically shows a part of an elevator installation in which the support plate 3 is to be mounted in the second installation position 11. At least two recesses 24 and 25, which serve for mounting the support plate 3, are provided in the shaft walls 18 and 20 respectively in the second installation position 11 per shaft wall. The support plate 3 has, at opposite ends, rotatable locking devices 26 which are preferably arranged below the support plate 3 and which come to rest in the recesses 24 and 25. In the state of mounting in the installation positions 10, 11 the locking devices 26 laterally protrude beyond the support plate 3 and lie in the recesses 24 and 25. Cables 27 by way of which the locking devices 26 can be rotated are preferably arranged at the locking devices 26. Chains can also be used instead of the cables 27.

The support plate 3 is released from the first position 10 in that it is raised by the chain hoist 14, which is illustrated in FIG. 1, by means of the support chain 15. During the raising, the locking devices 26 are moved against the movement direction of the support plate 3. The locking devices 26 preferably fold away downwardly.

The support plate 3 is raised above the height of the second installation position 11, preferably by 0.5 meters. The cables 27 are then tightened in order to rotate the locking devices 26 so that they protrude into the recesses 24, 25. The rotational movement of the locking device 26 is illustrated in FIG. 3 by dashed-line locking devices. The cables 27 can be actuated from scaffolding (not illustrated) mounted in the elevator shaft 2. Actuation of the cables 27 can be carried out, for example, manually or by means of chain hoist. After the locking devices 26 have been rotated so that they laterally protrude beyond the support plate 3 into the recesses 24, 25 the support plate 3 for mounting in the second installation position 11 is lowered by way of the chain hoist 14 and the support chain 15 so that the locking devices 26 come to rest in the recesses 24, 25.

Obviously the support plate 3 according to the example of the embodiment illustrated in FIG. 2 can also be provided with the above-described locking device 26 at least at the end of the support plate 3 associated with the recess 19. For elevatoring of the support plate 3 the locking device 26 is rotated, in particular folded away downwardly. The support plate 3 is moved horizontally upwards by the locking device 26. For mounting in the second installation position 11 the locking device 26 is moved by means of the cable 27 back into a horizontal position.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of constructing an elevator installation, which installation includes a support plate with a drive unit removably mounted in a first installation position in an elevator shaft, an elevator car and a counterweight, wherein the drive unit is connected with the elevator car and the counterweight by a support cable, comprising the steps of:

a. mounting of a cross-member having a chain hoist above a second installation position in the elevator shaft higher than the first installation position and below an upper edge of the elevator shaft when completed;

b. connecting the chain hoist with the support plate with a support chain;

c. releasing the support plate from the first installation position;

d. raising the support plate by the chain hoist from the first installation position to the second installation position;

e. mounting The support plate in the second installation position by providing locking devices at ends of the support plate; and f. moving the locking devices to protrude laterally beyond the support plate by cables or chains.

2. The method according to claim 1 including securing the elevator car and the counterweight from movement prior to release of the support plate from the first installation position and after mounting of the support plate in the second installation position removing the securing.

3. The method according to claim 2 including releasing the support cable connection between the drive unit and the elevator car and the counterweight after the securing of the elevator car and the counterweight and reconnecting the support cable after mounting the support plate in the second installation position.

4. The method according to claim 1 including separating a current supply cable from the drive unit prior to release of the support plate from the first installation position and reconnecting the current supply cable with the drive unit after mounting the support plate in the second installation position.

5. The method according to claim 1 including after releasing the support plate from the first installation position, moving the support plate vertically by the chain hoist and rotating locking devices, which are provided at ends of the support plate and in the mounted state protrude laterally beyond the support plate, against the direction of movement of the support plate.

6. The method according to claim 1 including releasing the support plate from the first installation position by raising from a rest protruding from a shaft wall into an elevator shaft.

7. The method according to claim 6 including when raising the support plate into the second installation position, turning the support plate to such an extent through an acute angle that it can move through the elevator shaft without contacting the shaft walls.

8. An elevator installation including an elevator shaft, a support plate with a drive unit in a first installation position, an elevator car and a counterweight, wherein the support plate with the drive unit, the elevator car and the counterweight are arranged in the elevator shaft and wherein the drive unit is connected with the elevator car and the counterweight by a support cable, comprising:

at least one recess for mounting the support plate is formed in a shaft wall of the elevator shaft at each of the first installation position and a second installation position; and locking devices positioned at ends of the support plate and being movable by chains or cables to protrude laterally beyond the support plate.

9. The elevator installation according to claim 8 including a rest for the support plate protruding into the elevator shaft from a shaft wall opposite said at least one recess.

10. The elevator installation according to claim 8 including another recess formed in a shaft wall opposite said at least one recess, and said locking devices being rotatable locking devices provided at opposite ends of the support plate for mounting in a respective one of said recesses.

11. A method of constructing an elevator installation, which installation includes a support plate with a drive unit removably mounted in a first installation position, an elevator car and a counterweight, wherein the drive unit connected with the elevator car and the counterweight by a support cable, comprising the steps of:

a. mounting of a cross-member having a chain hoist above a second installation position higher than the first installation position;

b. connecting the chain hoist with the support plate with a support chain;

c. releasing the support plate from the first installation position;

d. raising the support plate by the chain hoist from the first installation position to the second installation position; and e. mounting the support plate in the second installation position by providing locking devices at ends of the support plate and moving the locking devices to protrude laterally beyond the support plate by cables or chains.

* * * * *